US005291091A

United States Patent [19]

Eggink et al.

[11] Patent Number: 5,291,091

[45] Date of Patent: Mar. 1, 1994

[54] ELECTRODELESS LOW-PRESSURE DISCHARGE

[75] Inventors: Hendrik J. Eggink; Winand H. A. M. Friederichs; Nicasius C. T. Van Gennie, all of Eindhoven, Netherlands

[73] Assignee: U.S. Philips Corporation, New York, N.Y.

[21] Appl. No.: 818,003

[22] Filed: Jan. 8, 1992

[30] Foreign Application Priority Data

Jan. 25, 1991 [NL] Netherlands ..... 9100124

[51] Int. Cl.[5] ..... H01J 61/52; H01J 1/50

[52] U.S. Cl. ..... 313/161; 313/44; 313/46; 313/493; 315/248; 315/344

[58] Field of Search ..... 313/161, 34, 44, 45, 313/46, 493, 25, 27, 248, 344, 47, 231.41, 231.61, 317, 325; 362/264

[56] References Cited

U.S. PATENT DOCUMENTS 4,536,675 8/1985 Postma ..... 131/161 X
5,006,752 4/1991 Eggink et al. ..... 313/493 X
5,130,912 7/1992 Feiederichs et al. ..... 313/493 X

*Primary Examiner*—Donald J. Yusko
*Assistant Examiner*—Ashok Patel
*Attorney, Agent, or Firm*—Brian J. Wieghaus

[57] ABSTRACT

The electrodeless low-pressure discharge lamp has a lamp vessel (1) having a cavity (2) at an end portion (3) thereof. An electric coil (4) surrounding a plastic sleeve (5), wherein a liquid-filled tubular container (7) surrounded by a soft-magnetic core (6) is present, is accommodated in the cavity (2). The plastic sleeve (5) is substantially filled up with an elastic polymer. Additionally, the tube (5) may be enveloped by an elastic polymer (9). The elastic polymer ensures a relatively low operating temperature of the members inside the cavity (4).

14 Claims, 1 Drawing Sheet

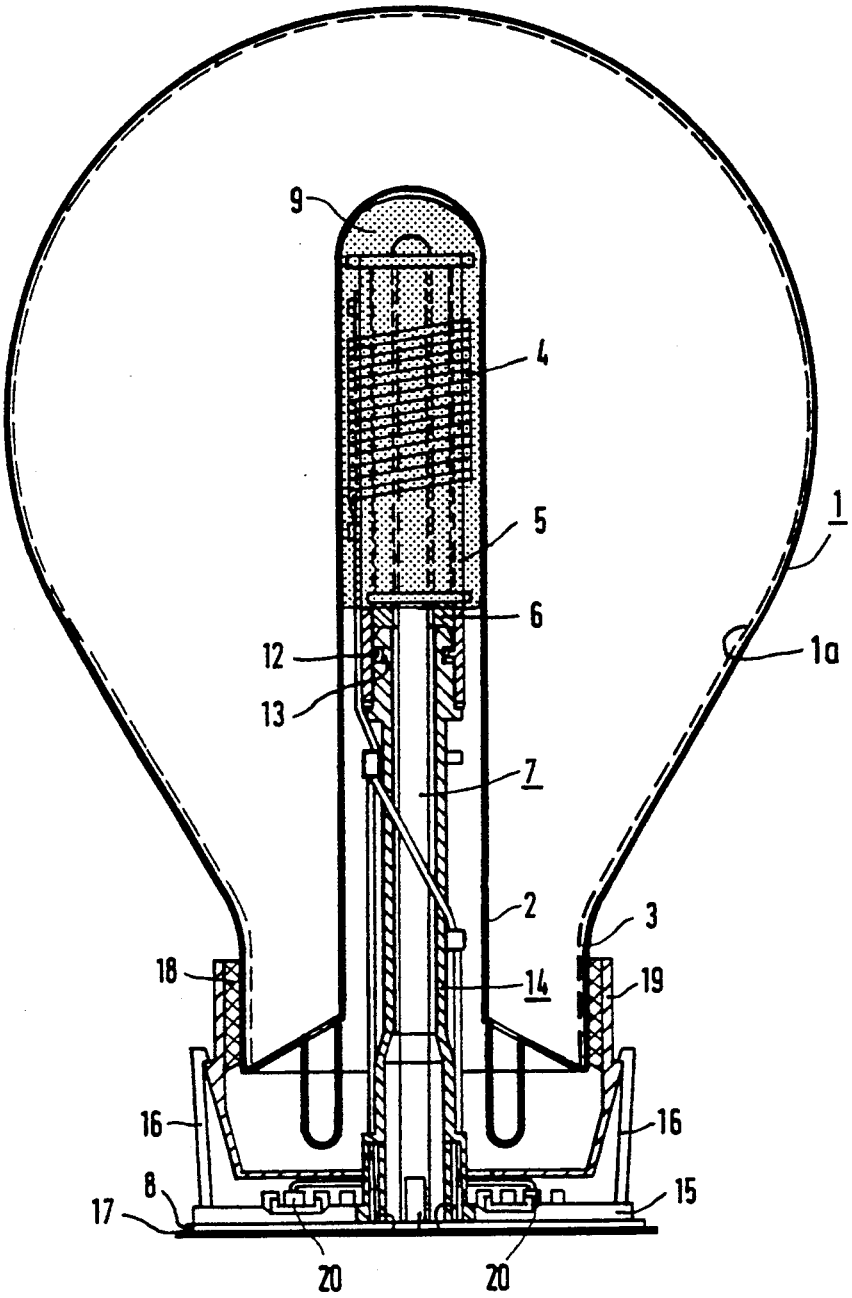
9
4
5
1
6
1a
12
13
7
2
3
18
14
19
16
16
8
15
17
20
20

ELECTRODELESS LOW-PRESSURE DISCHARGE

CROSS REFERENCE TO RELATED APPLICATIONS

This application relates to U.S. patent application Ser. No. 5,211,472 entitled "Electric Lamp and Dismantling Tool for Same" of Winand H.A.M. Friederichs and Nacasius G. T. Van Gennip, which discloses and claims an electric lamp having a mounting member which permits removal of the lamp from its support and to U.S. patent application Ser. 818,195 filed Jan. 8, 1992 of Hendrik Jan Eggink and Winand Hendrik Friederichs which discloses and claims an electrodeless mercury vapor discharge lamp having improved cooling of the magnetic core, both of which were filed simultaneously herewith.

The invention relates to an electrodeless low-pressure discharge lamp comprising

- a lamp vessel which is sealed in a vacuum tight manner, contains ionizable metal vapour and rare gas, and has a cavity at an end portion of said vessel,
- an electric coil around a sleeve of synthetic material in the cavity of the lamp vessel,
- a core of soft magnetic material in the sleeve of synthetic material,
- a tube containing a liquid in the core of soft magnetic material, which tube projects to outside the cavity and has a flange there.

Such a lamp is known from EP-0 384 520.

The lamp is provided with a tube containing a liquid in order to discharge heat generated during operation of the lamp, so that the core of soft magnetic material does not reach too high a temperature. This is because the specific magnetic losses of the core increase with increasing temperature, whereas the magnetic permeability starts to decrease from a raised temperature. It is the object of the cooling by means of the tube containing liquid to suppress these factors, which adversely affect the luminous efficacy of the lamp. Despite the provision of the liquid-containing tube, the temperature of the core of the known lamp is still unfavorably high.

SUMMARY OF THE INVENTION

The invention has for its object to provide a lamp of the kind described in the opening paragraph which is of a simple construction and in which nevertheless the temperature of the core can be relied on to have a comparatively low value.

This object is achieved in that the sleeve is at least substantially filled with an elastic polymer.

The core and the tube each have their own thermal coefficient of expansion. As a result of this and of the tolerances which have to be accepted with regard to the dimensions of these bodies, it is difficult to achieve a close contact between the tube and the core while preventing stresses from occurring which may crack the core.

It is true that one can aim at a close fit of the tube in the core during operation, but even then heat transfer must take place through a slit between the tube and the core. Since the tube, being the innermost body, has the smaller surface, a comparatively great heat flow must still run per unit area.

Since the space inside the sleeve in the lamp according to the invention is at least substantially filled with an elastic polymer, there is a close connection between the core and the tube.

The sleeve and the core may be made closely fitting, for example, in that the core is ground to the correct diameter. There is a good heat transfer between the sleeve and the core then, also because the core has a comparatively large outer surface. Alternatively, there may be a clearance between the sleeve and the core which is filled up with the elastic polymer. A better heat transfer to the tube, and from there to the surroundings of the lamp, is achieved by the measure according to the invention.

In a favourable embodiment, the sleeve is not only filled with, but also enveloped in the elastic polymer. A lower heat resistance is realised in this way, so that the cavity of the lamp vessel forms a cooler ambience for the core. An enveloped sleeve also has the advantage that the coil remains fixed around the sleeve. Expansion of the coil at operating temperature could cause the coil to sag over lamp life and assume a greater pitch.

It is favourable for easy manufacture of the lamp if the lamp vessel on the one hand and the assembled body in the cavity on the other hand are separate sub-assemblies. In view of the tolerances which must be permitted for the dimension of the cavity in the lamp vessel, a body which consists mostly of glass, it is not safeguarded then that the enveloped sleeve is in contact with the lamp vessel all around. The surface of the envelope of the sleeve, being the outermost surface, however, is much greater than the surface of the tube. The heat flow per unit area is therefore much smaller, so that a less close contact between the lamp vessel and the envelope is of minor influence.

The use of an elastic polymer is also advantageous in that differences in coefficient of expansion between the materials on which the various bodies are manufactured, especially those of the tube and the core, can be easily accommodated. Frequently used materials are: glass for the lamp vessel; synthetic material, for example liquid crystalline polymer, for the tube; ferrite, for example Philips 4C6, for the core; metal, for example copper, for the tube; and, for example, rubber, such as silicone rubber, as an elastic polymer.

In addition, the lamp is better resistant to shocks and vibrations, for example, during transport.

BRIEF DESCRIPTION OF THE DRAWINGS

This and other more detailed aspects of the invention are described and explained with reference to the drawing in which a lamp is shown partly in cross-section, partly in elevation.

DESCRIPTION OF THE PREFERRED EMBODIMENTS

The electrodeless low-pressure discharge lamp has a lamp vessel 1 which is closed in a vacuum tight manner, is made of, for example, lime glass, contains ionizable metal vapour and rare gas, and comprises a cavity 2, for example of lead glass, at an end portion 3 of said vessel.

An electric coil 4 around a sleeve 5 of synthetic material is present in the cavity 2. A core 6 of soft magnetic material is present in the sleeve 5 of synthetic material. Cooling means are provided for transferring heat from the magnetic core to the exterior of the cavity. The cooling means includes a tube 7 containing liquid which is present in the core 6, projects to outside the cavity 2, and has a flange 8 there.

In the embodiment drawn, the lamp vessel 1 contains a rare gas and mercury as an ionizable metal and is coated with a fluorescent powder 1*a*.

The sleeve 5 is filled with an elastic polymer 9. The polymer fills the gap between the tube 7 and the core 6. In the embodiment drawn, the polymer also envelops the sleeve 5.

The tube 7, the core 6 and the sleeve 5 with the coil 4 in the drawing together with the polymer 9 form a subassembly which is provided as such in the cavity 2. The subassembly 4, 5, 6, 7, 9 is thus removable from the cavity 2. Silicone rubber is used as the polymer 9.

In the drawing, the sleeve 5 is fastened with a snap connection 12, 13 to a support 14 of synthetic material which has a flange 15, on which are present hooks 16, at a free end. The flange 8 of the tube 7 and the flange 15 of the support 14 are fastened to one another and a foil 17 of synthetic material, for example silicone rubber, is provided against the flange 8. As a result, the lamp may be mounted against a metal support without the risk of a galvanic element being formed by this support and the flange 8. A collar 19 of synthetic material, which is held by the hooks 16, is mounted to the lamp vessel 1, for example with silicone compound 18. A cable leading to an electric supply may be connected to contacts 20 at the flange 15, to which the coil 4 is connected.

We claim:

1. An electrodeless low-pressure discharge lamp comprising a lamp vessel which is sealed in a vacuum-tight manner, contains ionizable metal vapor and rare gas, and has a cavity at an end portion of said vessel, a sleeve of synthetic material within the cavity of the lamp vessel, a core of soft magnetic material within the sleeve, an electric coil around the sleeve, a tube containing a liquid in the core of soft magnetic material, which tube projects to, and has a flange, outside the cavity characterized in that: the sleeve is at least substantially filled with an elastic polymer.

2. An electrodeless low-pressure discharge lamp as claimed in claim 1, characterized in that the sleeve is enveloped in the polymer.

3. An electrodeless low-pressure discharge lamp as claimed in claim 2, characterized in that the enveloped sleeve with the coil, the core, and the tube form a subassembly which is insertable into the cavity of the lamp vessel.

4. An electrodeless low-pressure discharge lamp as claimed in claim 3, characterized in that the polymer is silicone rubber.

5. An electrodeless low-pressure discharge lamp as claimed in claim 2, characterized in that the polymer is silicone rubber.

6. An electrodeless low-pressure discharge lamp as claimed in claim 1, characterized in that the polymer is silicone rubber.

7. An electrodeless low-pressure discharge lamp as claimed in claim 1, characterized in a the enveloped sleeve with the coil, the core, and the tube form a subassembly which is insertable into the lamp vessel cavity.

8. An electrodeless low-pressure discharge lamp as claimed in claim 7, characterized in that the polymer is silicone rubber.

9. An electrodeless low-pressure discharge lamp, comprising:

a) sealed lamp vessel containing an ionizable metal vapor and a rare gas, said lamp vessel having a wall extending into the lamp vessel and defining a cavity in said lamp vessel; and b) a sub-assembly insertable into said cavity and comprising a sleeve, an electric coil having turns coiled about said sleeve, a core of magnetic material within said sleeve, a cooling means extending from said core for transferring heat from said core to the exterior of said cavity, said cooling means having a gap with said core, and an elastic polymer substantially filling said gap between said core and said cooling means for facilitating heat transfer between said core and said cooling means.

10. An electrodeless lamp according to claim 9, wherein said sleeve and said coil are enveloped by the elastic polymer for holding said coil and preventing movement of said coil turns on said sleeve over lamp life.

11. An electrodeless lamp according to claim 10, wherein said polymer extends to said wall which defines said cavity for cushioning said sleeve, coil, core and cooling means from shock.

12. An electrodeless discharge lamp according to claim 9, wherein said cooling means includes a tube containing a liquid.

13. An electrodeless low-pressure discharge lamp, comprising:

a) sealed lamp vessel containing an ionizable metal vapor and a rare gas, said lamp vessel having a wall extending into the lamp vessel and defining a cavity in said lamp vessel;

b) a mass of polymer substantially filling a portion of said cavity; and c) a sleeve, an electric coil coiled about said sleeve, a core of magnetic material within said sleeve, and a cooling means for transferring heat from said core to the exterior of said cavity, said cooling means extending from within said core of magnetic material to the exterior of said cavity such that said sleeve, said core, said coil, and a portion of said cooling means within said core are enveloped by said mass of polymer.

14. An electrodeless discharge lamp according to claim 13, wherein said cooling means includes a tube containing a liquid.

* * * * *